US012774595B2

(12) United States Patent
Wilson

(10) Patent No.: US 12,774,595 B2
(45) Date of Patent: Oct. 27, 2026

(54) WATER CONTAINMENT SYSTEMS, ASSEMBLIES, AND METHODS OF ASSEMBLING SAME

(71) Applicant: Thomas Wilson, Edmonton (CA)

(72) Inventor: Thomas Wilson, Edmonton (CA)

( * ) Notice: Subject to any disclaimer, the term of this patent is extended or adjusted under 35 U.S.C. 154(b) by 13 days.

(21) Appl. No.: 18/905,957

(22) Filed: Oct. 3, 2024

(65) Prior Publication Data

US 2025/0188728 A1 Jun. 12, 2025

(51) Int. Cl.
*E03F 5/10* (2006.01)

(52) U.S. Cl.
CPC ..... *E03F 5/106* (2013.01)

(58) Field of Classification Search
CPC ..... Y10T 137/5762; Y10T 137/86067; E03F 5/106; E03B 7/095
See application file for complete search history.

(56) References Cited

U.S. PATENT DOCUMENTS

| | | | | |
|---|---|---|---|---|
| 4,909,274 | A | 3/1990 | Rodriguez | |
| 5,188,143 | A | 2/1993 | Krebs | |
| 5,452,739 | A * | 9/1995 | Mustee | A47L 15/4212 4/251.1 |
| 5,645,103 | A * | 7/1997 | Whittaker | F24H 9/17 220/571 |
| 5,881,762 | A * | 3/1999 | Janesky | F24H 9/17 220/571 |
| 6,135,133 | A * | 10/2000 | Ridgeway, Jr. | F24H 9/17 220/571 |
| 8,893,917 | B1 | 11/2014 | Russell | |
| 10,330,257 | B2 | 6/2019 | Lambert | |

FOREIGN PATENT DOCUMENTS

| | | |
|---|---|---|
| CA | 2110466 | 6/1995 |
| GB | 2339829 | 2/2000 |
| GB | 2394249 | 4/2004 |

OTHER PUBLICATIONS

Legault-Dubois, 3 Ways to Minimize Damage Related to your Water Heater, Obtained Sep. 22, 2023, 4 pages.
Basement Systems, FloodRing®—Water Tank Protection System, Available as early as Sep. 2023, 5 pages.
Quick Dams, Water Dams, available as early as Sep. 2023, 4 pages.
Floodproofing, Utility Flood Covers, obtained Sep. 22, 2023, 3 pages.
Lowe's, Eastman 24-in×26-in Plastic Water Heater Drain Pan with Fitting, Obtained Sep. 22, 2023, 2 pages.
Lowe's, KMG 24-in×24-in Galvanized Steel Water Heater Drain Pan with Fitting, Obtained Sep. 22, 2023, 3 pages.

* cited by examiner

*Primary Examiner* — Daphne M Barry
(74) *Attorney, Agent, or Firm* — Robert A. Nissen

(57) ABSTRACT

A water containment system has: a peripheral dam formed of one or more arcuate longitudinal wall sections that are configured to be secured in an assembled position in use around a water tank as the water tank rests on a ground surface, the peripheral dam defining an open water-tank-receiving base; and a drain port defined in the peripheral dam. In a method of retrofitting a water containment system around a water tank, the method includes: assembling a peripheral dam, formed of one or more arcuate longitudinal wall sections around the water tank as the water tanks rests on a ground surface; securing the peripheral dam to the ground surface; and connecting a drain line from a drain port in the peripheral dam to a drain.

16 Claims, 4 Drawing Sheets

WATER CONTAINMENT SYSTEMS, ASSEMBLIES, AND METHODS OF ASSEMBLING SAME

TECHNICAL FIELD

This document relates to water tank, water valve, and sump pit water containment systems, assemblies, and methods of assembling same.

BACKGROUND

The following paragraphs are not an admission that anything discussed in them is prior art or part of the knowledge of persons skilled in the art.

The FloodRing™ water tank protection system incorporates semicircular parts that can be installed without disturbing a water heater or well tank.

SUMMARY

A water containment system is disclosed comprising: a peripheral dam formed of one or more arcuate longitudinal wall sections that are configured to be secured in an assembled position in use around a water tank, water valve, or sump pit, the peripheral dam defining an open tank-valve-or-pit-receiving base; and a drain port defined in the peripheral dam.

A method of retrofitting a water containment system around a water tank, water valve, or sump pit is disclosed, the method comprising: assembling a peripheral dam, formed of one or more arcuate longitudinal wall sections around the water tank, as the water tanks rests on a ground surface, or around the water valve or sump pit; securing the peripheral dam to the ground surface; and connecting a drain line from a drain port in the peripheral dam to a drain.

In various embodiments, there may be included any one or more of the following features: The peripheral dam forms a ring when in the assembled position. The peripheral dam is formed of a split ring. The one or more arcuate longitudinal wall sections comprise flexible or resilient extruded sections. Each of the one or more arcuate longitudinal wall sections comprises a double wall that defines a hollow interior. Each of the one or more arcuate longitudinal wall sections have a triangular cross-sectional wall profile. A base of each of the one or more arcuate longitudinal wall sections comprises adhesive-receiving channels. The peripheral dam comprises a drain wall section that defines the drain port. Axial ends of the drain wall section are configured to, in the assembled position, mate with axial ends of adjacent of the one or more arcuate longitudinal wall sections. The axial ends of the drain wall section are configured to mate with the axial ends of adjacent of the one or more arcuate longitudinal wall sections by a tongue and groove connection. The axial ends of the drain wall section comprise: an outer female flange shaped to permit the axial end of the one or more longitudinal wall section to insert within the outer female flange; and an inner male flange shaped to insert within a hollow interior of the axial end of the one or more longitudinal wall sections. The drain port is formed at least in part by a lateral peripheral flange. The lateral peripheral flange is a threaded collar or nipple. The peripheral dam secured in the assembled position on a ground surface encircling a water tank. The drain port is secured to a drain line that runs to a drain. The peripheral dam is secured by adhesive to one or more of itself and the ground surface. The peripheral dam secured in the assembled position on a ground surface encircling a sump pit. The peripheral dam secured in the assembled position on a ground surface encircling a water valve. Configuring the peripheral dam in the assembled position on a ground surface around a water tank that rests on the ground surface.

The foregoing summary is not intended to summarize each potential embodiment or every aspect of the subject matter of the present disclosure. These and other aspects of the device and method are set out in the claims.

BRIEF DESCRIPTION OF THE FIGURES

Embodiments will now be described with reference to the figures, in which like reference characters denote like elements, by way of example, and in which.

DETAILED DESCRIPTION

Figure 1:
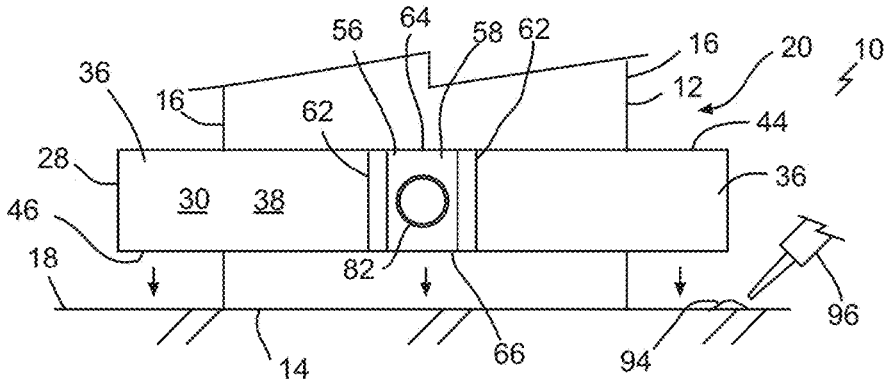
FIG. 1 is a side elevation view of a peripheral dam being installed around an existing water tank.

Immaterial modifications may be made to the embodiments described here without departing from what is covered by the claims.

A building's hot water system is an essential component of a modern plumbing infrastructure. A hot water system provides a consistent and reliable supply of heated water for various domestic and commercial purposes. A hot water system may involve a centralized heating unit, such as a boiler, which heats water and distributes it throughout the building via a network of pipes. The heated water may be delivered to taps, showers, and appliances, to allow for a comfortable and sanitary supply of hot water. Various technologies may be employed to regulate water temperature, such as thermostatic valves and controls, to meet specific needs and enhance energy efficiency. The design and implementation of a hot water system may require consideration of factors like building size, occupancy, water demand and supply, and local regulations to optimize performance and safety. Regular maintenance and monitoring may be undertaken to prevent issues such as corrosion, energy inefficiency, and leaks, to maintain the longevity and effectiveness of a hot water system.

One type of hot water system employs a hot water tank, also known as a water heater or well tank, and which may provide a continuous and readily available supply of heated water for domestic and commercial purposes. A hot water tank typically stores and heats water using electricity, gas, or via other energy sources, ensuring that hot water is readily available when needed. A hot water tank may be equipped with heating elements, burners, and a thermostat that controls water temperature to meet specific user requirements or settings. In residential settings, a hot water tank may be used for bathing, cleaning, cooking, sewage removal, and drinking water. Commercial and industrial applications often involve larger and more sophisticated tank systems than residential systems, to meet the higher expected demands of the former.

The basic structure of the hot water tank is a typically cylindrical drum that consists of an insulated container designed to store and heat water. The tank's outer shell may be constructed from materials like steel or stainless steel to provide durability and corrosion resistance. Inside the tank, a heating element, often powered by electricity or gas, is responsible for raising the temperature of the water to the desired level. The tank is equipped with a thermostat to regulate the water temperature and maintain consistency. To minimize heat loss and improve energy efficiency, hot water tanks may be insulated with materials like foam or fiberglass. Cold water enters the tank through an inlet pipe, is heated and remains at the heated temperature within the insulated drum until it is desired to be used, at which point the heated water exits the drum through an outlet pipe into the building's water supply pipe network. Safety features such as pressure relief valves are incorporated to prevent excessive pressure buildup. The design of hot water tanks considers factors like capacity, insulation, and overall efficiency to ensure reliable performance and longevity.

Water leakage and spills in a building can lead to structural damage, mold growth, and compromised indoor air quality. Common sources of water leaks include plumbing failures, roof damage, and inadequate waterproofing. Detection and prevention are critical ways to address such issues, often involving the use of moisture sensors, leak detection systems, and regular inspections. Rapid response to leaks is essential to minimize damage, and building designs frequently incorporate drainage systems, waterproof membranes, and proper sealing to mitigate the risk of water infiltration. Proper maintenance of building components, such as roofs, windows, and plumbing systems, is crucial in preventing water-related problems. Developing and implementing comprehensive water management plans can help mitigate the impact of leaks, ensuring the longevity and safety of the building structure.

Water infiltration in a basement or other part of a building may be caused by a leak or failure in a hot water tank. A hot water tank leak may arise from various factors, posing potential risks to the building structure and its occupants. Corrosion of parts is a common cause of leaks in a hot water tank, often due to the interaction between metal components and water over time. Sediment buildup at the bottom of the tank may compromise the integrity of the tank, and may exacerbate corrosion issues. Additionally, high water pressure can contribute to leaks, stressing the tank walls and joints. Faulty temperature or pressure relief valves, which are designed to release excess pressure, may lead to leaks.

Various methods and solutions may be implemented to prevent damage caused by hot water tank leaks. Regular maintenance is a key component, involving inspections for signs of corrosion, sediment buildup, or any wear on the tank components. Installing a drip pan prior to installation of the hot water tank, so that the drip pan resides below (underneath) the hot water tank to catch leaks, may help contain and leaks and prevent water damage to the surrounding area. The drip pan may be installed beneath the hot water tank and connected to a drainage system. Temperature and pressure relief valves should be inspected and replaced if necessary to ensure proper functioning. Water leak detection systems, equipped with sensors and alarms, offer an additional layer of protection by providing real-time alerts when a leak is detected. Adequate insulation of the tank, as well as pipes connected to it, helps to reduce the risk of condensation and corrosion. Additionally, monitoring and controlling water pressure within recommended levels can contribute to the prevention of leaks. By combining these proactive measures, building owners and managers can significantly reduce the likelihood of damage caused by hot water tank leaks and enhance the overall safety and longevity of the plumbing system.

There are few preventive measures available for retrofitting to an existing hot water tank already installed in a building. One approach is to retrofit an existing tank with a leak detection system comprising sensors and alarms. Retrofitting temperature and pressure relief valves or upgrading them to newer, more reliable models can also enhance the tank's safety features. Retrofitting an existing hot water tank with a drip pan may be inconvenient, and in some cases not possible for the average homeowner to do on their own, as it requires turning off the water supply, draining the hot water tank, moving or lifting the hot water tank, and possibly also disconnecting the water supply from the hot water tank. Water tank dams, such as the FloodRing™, have been designed to surround the existing hot water tank, without disturbing the hot water tank, and contain any leaks that may occur. Water tank dams may prevent small amounts of water from spreading beyond the dam barrier and contain the water until the water can be removed, for example by a sump pump or other suitable means.

Figure 2:
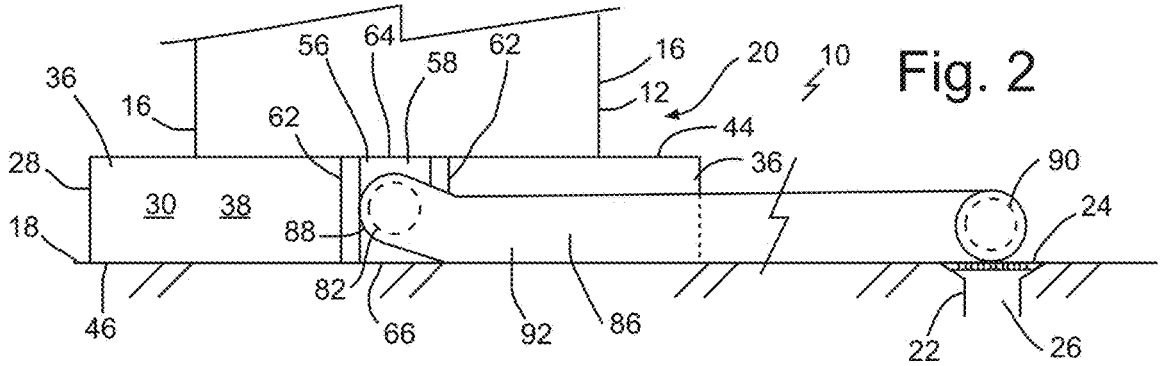
FIG. 2 is a side elevation view showing the peripheral dam of FIG. 1 installed in the assembled position around an existing water tank, with a drain line configured to drain into a floor drain.
Figure 3:
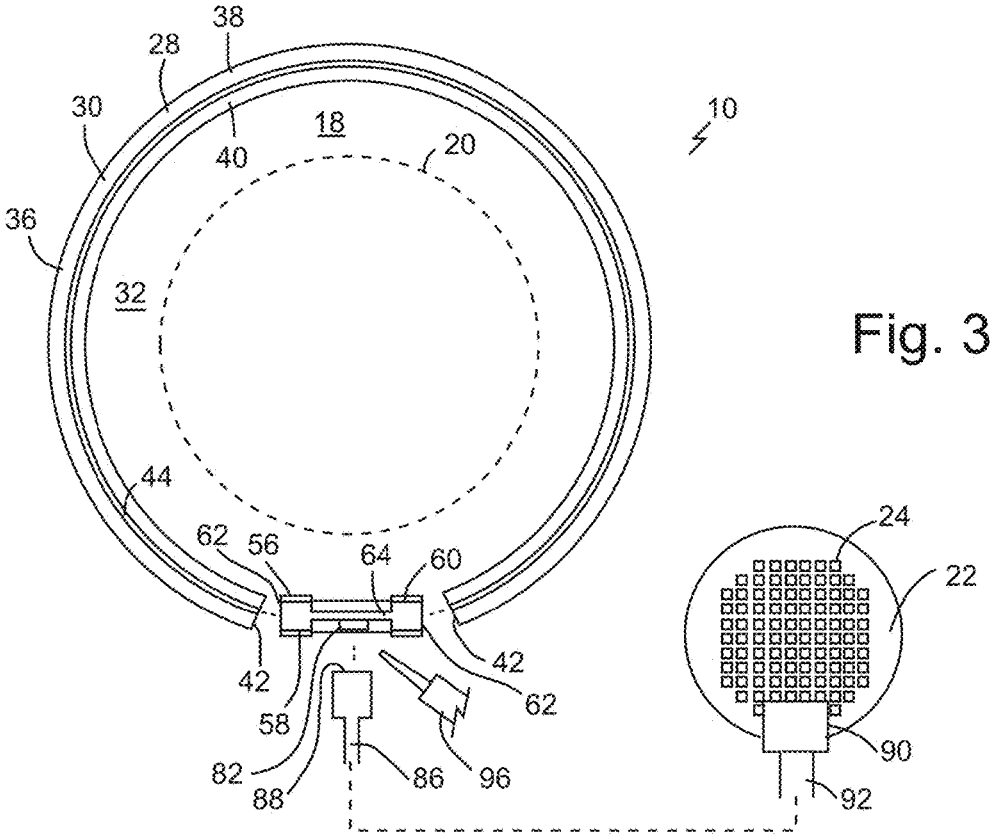
FIG. 3 is a top plan view of the peripheral dam of FIG. 1 being retrofitted around the water tank, with the drain line configured to drain into the floor drain.

Referring to FIGS. 1-3, a water containment system 10 is disclosed. The water containment system 10 comprises a peripheral dam 28. The peripheral dam 28 may be formed of one or more arcuate longitudinal wall sections 36. In use, the peripheral dam 28 may be assembled (placed into an assembled position) on a ground surface 18, around a water tank 12 that rests on the ground surface 18. In other cases the dam 18 may be assembled around a sump pit or water valve (such as the inlet valve of a residential or other building water supply. The one or more arcuate longitudinal wall sections 36 may be configured to be assembled in use around the water tank 12 as the water tank 12 rests on the ground surface 18. The peripheral dam 28 may define an open water-tank-receiving base 32, for example if the dam 28 is assembled by arcuate wall parts as shown, that do not form or contribute to a base that would otherwise underlie the hot water tank. Because the base 32 is open, the dam 28 can be assembled by encircling the tank 12 and hermetically sealing the ends of the dam 28 together and the base of the dam 28 to the floor. When in the assembled position (FIG. 2), a water tank zone 20 may be defined within the open water-tank-receiving base 32. A drain port 82 may be defined in the peripheral dam 28, for example the drain port 82 may be defined in a drain wall section 56 of the peripheral dam 28. The water containment system 10 may be in use retrofitted around the water tank 12 by assembling the peripheral dam 28, formed of one or more arcuate longitudinal wall sections 36 around the water tank 12 as the water tanks rests on a ground surface 18, securing the peripheral dam 28 to the ground surface 18, and connecting a drain line 86 from a drain port 82 in the peripheral dam 28 to a drain 22.

Referring to FIGS. 3-10, the peripheral dam 28 may be configured to form a ring when in an assembled position. In the example shown, the wall sections 36 and 56 may be structured to cooperate to form the ring when in the assembled position. The peripheral dam 28, for example a single arcuate longitudinal wall section 36, may be formed of a split ring as shown. The dam 28 may be completed by securing axial ends 42, for example using adhesive 94 from an adhesive gun 96 or through the use of a connection piece, for example the drain wall section 56. The one or more arcuate longitudinal wall sections 36 may comprise flexible or resilient sections, in order to facilitate the opening and closing of the ring to encircle the hot water tank 12.

Figure 4:
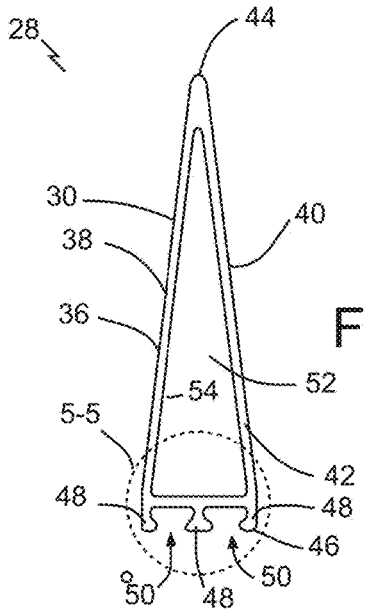
FIG. 4 is an end view of a peripheral side wall of the peripheral dam of FIG. 1.
Figure 5:
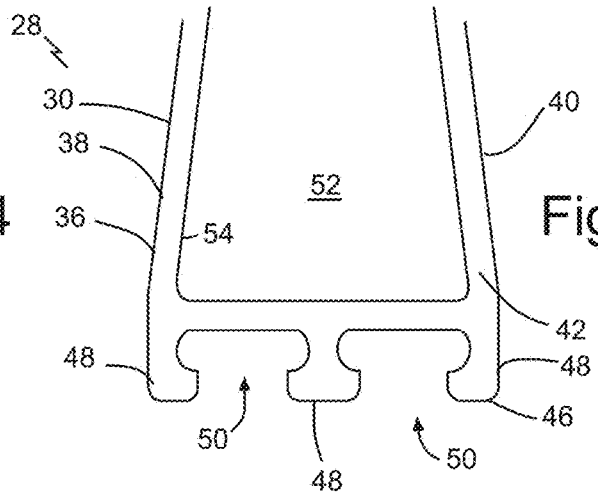
FIG. 5 is a close-up end view, of the area in FIG. 4 denoted by the 5-5 dashed lines, illustrating a base region of the peripheral side wall of FIG. 4.
Figure 6:
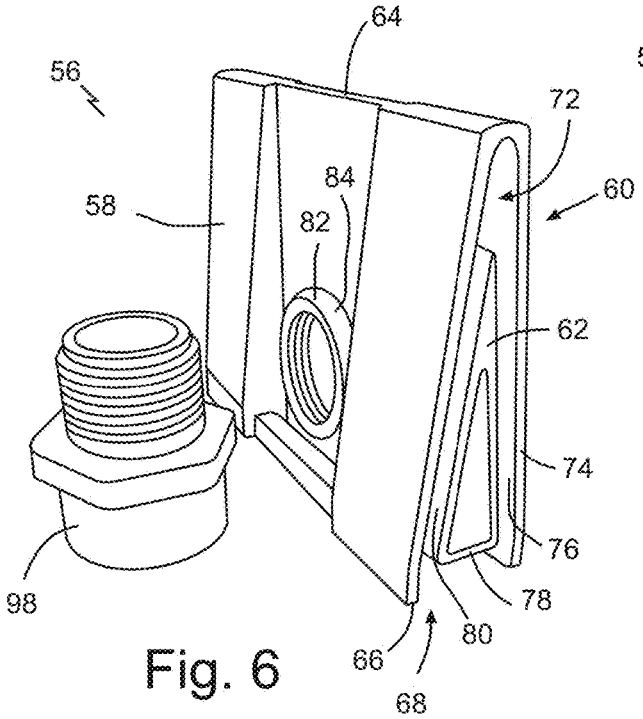
FIG. 6 is a perspective view of a kit comprising a drain wall section of the peripheral dam, and a threaded drain pipe connector/hose adapter, of FIG. 1.
Figure 7:
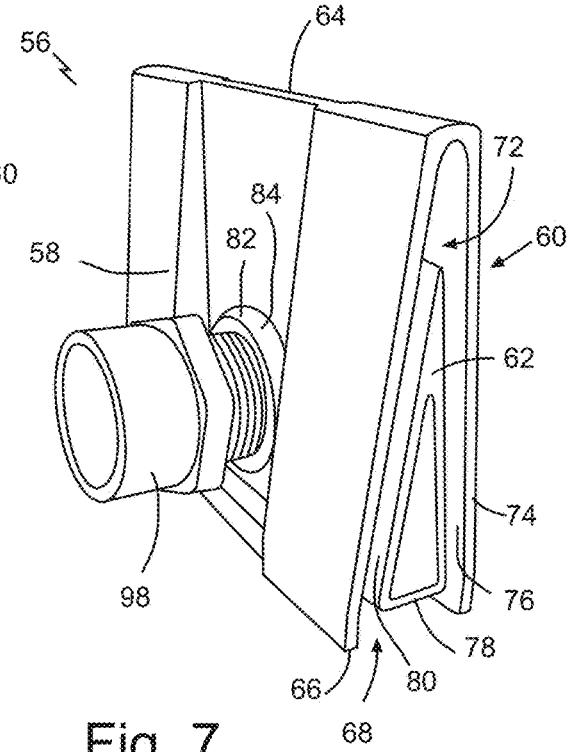
FIG. 7 is a perspective view of the kit of FIG. 6, with the drain pipe connector connected to a threaded collar of the drain wall section.
Figure 8:
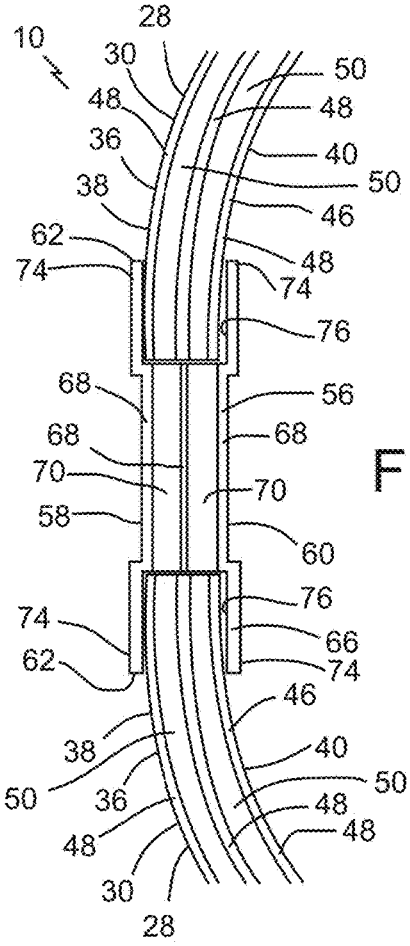
FIG. 8 is a bottom plan view of a portion of the peripheral dam of FIG. 1, illustrating the connection between the drain wall section and the axial ends of the arcuate longitudinal wall section.
Figure 9:
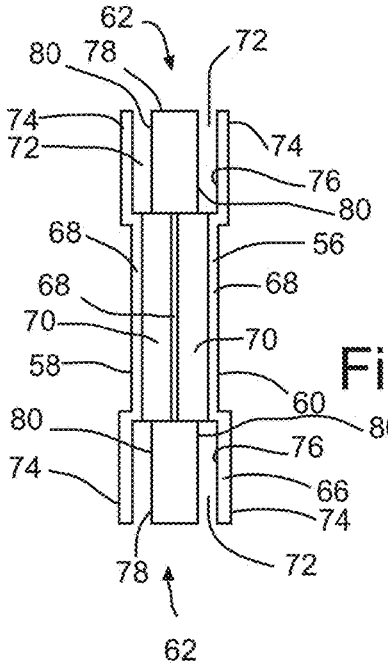
FIG. 9 is a bottom plan view of the drain wall section of FIG. 6.
Figure 10:
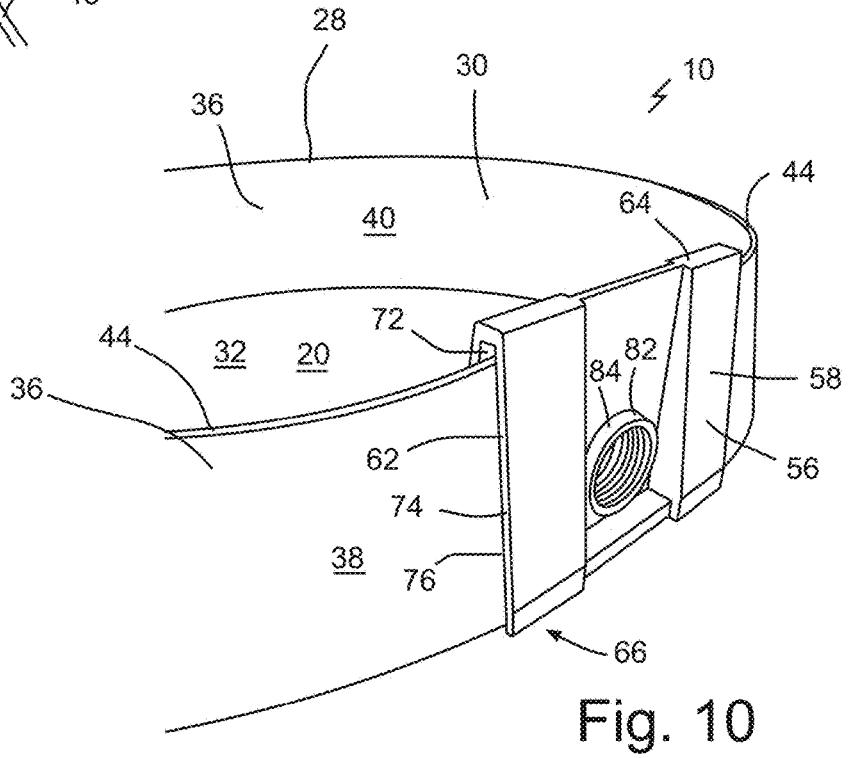
FIG. 10 is a perspective view of the portion of the peripheral dam illustrated in FIG. 8.

Referring to FIGS. 4-5, in some cases, the arcuate wall section or sections 36, and/or the drain wall section 56, may be formed by extrusion, i.e. provided in extruded sections. Extrusion is a versatile and widely used manufacturing process in which a material, typically a thermoplastic or metal, is forced through a die to produce a continuous profile with a constant cross-section. The process may begin with raw material, such as plastic pellets or metal billets, being fed into the extruder, where it is heated and softened. The molten material is then forced through a specially designed die, which imparts the desired shape to the emerging product. Extrusion finds application in various industries, including plastics, aluminum, and food processing, to create a diverse range of products such as pipes, tubes, sheets, and profiles. The method offers several advantages, including high production speeds, cost-effectiveness, and the ability to produce complex shapes with consistent quality. Additionally, extrusion enables the manufacturing of long, continuous lengths of products, minimizing the need for secondary operations and enhancing overall efficiency in the production process.

Referring to FIGS. 1-5, the one or more wall sections 36 may each have a suitable structure. The wall sections 36 may form a peripheral side wall 30, which is hermetically sealed against water leakage once the dam 28 is secured in the assembled position. Each side wall 30 may define an external face 38, an internal face 40 and opposed axial ends 42. The wall section 36 may define a top edge 44 and a base 46. The wall sections 36 may have a suitable structural frame, such as a double wall that defines a hollow interior 52. Should the section 36 be formed by extrusion, the hollow interior 52 would be formed by the use of the die through which the thermoplastic is drawn through. An inner wall 54 of the section 36 may define the hollow interior 52. The one or more wall sections 36, for example the double wall and base 46, may have a suitable profile, such as a triangular cross-sectional profile. The base 46 of each of the one or more arcuate longitudinal wall sections 36 may be structured to facilitate adhesion to the floor or ground surface 18, for example by defining adhesive-receiving channels 50 or indents in the base 46. The base 46 may comprise one or more feet 48 and the adhesive-receiving channels 50 may be defined between feet 48, which act as ridges with the channels 50 defined as valleys therebetween. The adhesive-receiving channels 50 may in use provide slots or other receptacles to receive adhesive 94 from the adhesive gun 96, to provide a capacity to hold the adhesive in contact with the section 36 and ground surface 18 while the adhesive sets. The adhesive 94 may be used to secure the wall sections 36 to the ground surface 18, and in some cases the drain wall section 56, in the assembled position.

Referring to FIGS. 1, 3, and 6-9, the peripheral dam 28 may comprise a drain wall section 56. The drain wall section 56 may define the drain port 82. The drain wall section 56 may comprise an external face 58, an internal face 60 and opposed axial ends 62. The drain wall section 56 may define a top edge 64 and a base 66. The axial ends 62 of the drain wall section 56 may be configured to mate with axial ends 42 of adjacent of the one or more arcuate longitudinal wall sections 36. The axial ends 62 of the drain wall section 56 may have a suitable shape to correspond with and engage the adjacent axial end 42 of the adjacent one or more arcuate wall sections 36. The axial ends 62 of the drain wall section 56 may comprise an outer female flange 74 and an inner male flange 78. The outer female flange 74 and the inner male flange 78 may define a hollow interior 72 for receiving the axial end 42 of the wall section 36. The outer female flange 74 may be shaped to permit the axial end 42 of the one or more longitudinal wall section 36 to insert within the outer flange 74. The outer female flange 74 may be defined by an inner wall surface 76. The inner male flange 78 may be shaped to insert within a hollow interior 52 of the axial end 42 of the one or more longitudinal wall sections 36. The inner male flange 78 may be defined by an outer wall surface 80. The drain wall section 56 may have feet 68 on the base 66, with the feet 68 defining ridges. The ridges of the feet 68 may define adhesive-receiving channels 70 or indents. The adhesive-receiving channels 70 may be configured to receive adhesive 94 from the adhesive gun 96, and hold the adhesive 94 in contact with both the drain wall section 56 and the ground surface 18. The adhesive 94 may be used to secure the drain wall section 56 to the ground surface 18 in the assembled position.

Referring to FIGS. 1-10, the peripheral dam 28 may be retrofitted in place on a hot water tank 12, for example assembled and secured on a ground surface 18 to encircle the water tank 12. The peripheral dam 28 may be secured by adhesive to itself and the ground surface 18. To move the parts into the assembled position, wall sections 36 may be positioned around the side walls 16 of the water tank 12. Once the wall section 36 (or sections if plural) is positioned around the water tank, the axial ends 42 of the wall section 36 may be connected to the axial ends 62 of the drain wall section 56 via adhesive, a friction fit, or both. Once it is in the assembled position, peripheral dam 28 may be secured around the base 14 of the water tank 12 to the ground surface 18 via adhesive 94 from an adhesive gun 96 or another suitable attachment method. The base 46 of the wall sections 36 and the base 66 of the drain wall section 56 may permit the dam 28 to be secured to the ground surface 18.

Referring to FIGS. 3, 6-7 and 10, the drain port 82 may be configured with a suitable structure. The drain port 82 may be at least partially defined by a lateral peripheral flange. The lateral peripheral flange may, at least in part, be formed by a threaded collar 84 or nipple. The drain port 82 may be secured to a drain line 86 that runs to a floor drain 22. The threaded collar 84 may connect to an inlet 88 of a drain line 86 or to a connector/hose adapter 98. Adhesive 94 may be used in the connection between the threaded collar 84 and the inlet 88 of a drain line 86 or a connector adapter 98. The connector adapter 98 may connect to the inlet 88 of the drain line 86 via a suitable mechanism. The drain line 86 may define a pipe body 92 and an outlet 90. The outlet 90 of the drain line 86 may be positioned at or near the floor drain 22. Water that leaks from the water tank 12 and rises to a sufficient height may drain by gravity out of the drain port 82, flow through the drain line 86, into the floor drain 22 and then into the drain piping 26. The drain line 86 may be secured to the ground surface 18 in such a way that the outlet 90 is fixed on or near the floor drain 22. The outlet 90 may be structured so that the outlet 90 is resting on top of the grating 24 of the floor drain or integrated with the grating 24 of the floor drain 22. In some cases, the outlet 90 may be secured, for example with adhesives, fasteners, welding, or other connections, to the grating 24 or otherwise to the drain 22.

Figure 11:
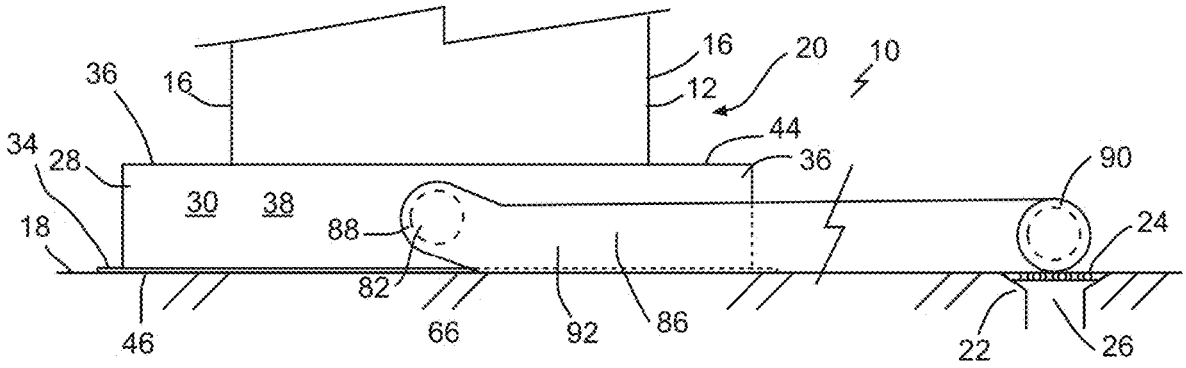
FIG. 11 is a side elevation view, partially in section, of another embodiment of a peripheral dam installed around a water tank, the peripheral dam formed of two arcuate longitudinal wall sections and a drain wall section, with a drain line configured to drain into a floor drain.
Figure 12:
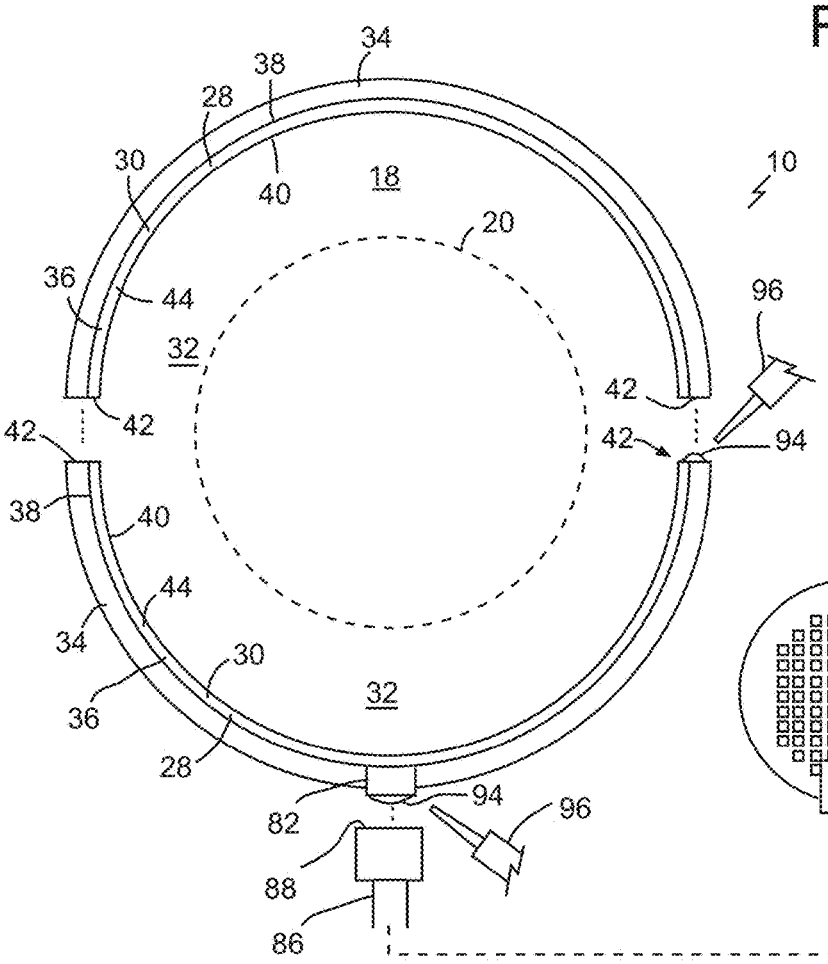
FIG. 12 is a top plan view of the peripheral dam of FIG. 11 being retrofitted around an existing water tank, with the drain line configured to drain into the floor drain.

Referring to FIGS. 11-12, an additional embodiment is disclosed. The one or more arcuate longitudinal wall sections 36 in the example shown may comprise plural arcuate longitudinal wall sections 36. The plural arcuate longitudinal wall sections 36 may be secured to each other end-to-end and to the ground surface 18 via adhesive 94. The plural arcuate longitudinal wall sections 36 may each comprise a base flange 34. The base flange 34 may increase the surface area available to secure the plural arcuate longitudinal wall sections 36 to the ground surface 18. The drain port 82 may be defined in the peripheral side wall 30 of the plural arcuate longitudinal wall sections 36. The drain port 82 may be secured to a drain line 86 that runs to a floor drain 22. The peripheral dam 28 may be assembled and secured on a ground surface 18 encircling the water tank 12. The plural arcuate longitudinal wall sections 36 may be positioned around the side walls 16 of the water tank 12. Once the plural arcuate longitudinal wall sections 36 are positioned around, for example retrofitted to, the water tank, the axial ends 42 of the plural arcuate longitudinal wall sections 36 may be connected to each other via adhesive 94. Once it is in the assembled position, peripheral dam 28 may be secured around the base 14 of the water tank 12 to the ground surface 18 via adhesive 94 from an adhesive gun 96 or another suitable attachment method.

Referring to FIGS. 11-12, the drain port 82 may comprise a suitable structure. The drain port 82 may be defined by a lateral peripheral flange. The lateral peripheral flange may be a threaded collar 84 or nipple. The drain port 82 may be secured to a drain line 86 that runs to a floor drain 22. The threaded collar 84 may connect to an inlet 88 of a drain line 86 or a connector adapter 98. Adhesive 94 may be used in the connection between the threaded collar 84 and the inlet 88 of a drain line 86 or a connector adapter 98. The connector adapter 98 may connect to the inlet 88 of the drain line 86. The drain line 86 may define a pipe body 92 and an outlet 90. The outlet 90 of the drain line 86 may be positioned at or near the floor drain 22. Water that leaks from the water tank 12 may drain out of the drain port 82, flow through the drain line 86, into the floor drain 22 and then into the drain piping 26. The drain line 86 may be secured to the ground surface 18 in such a way that the outlet 90 is fixed on or near the floor drain 22. The outlet 90 may be structured so that the outlet 90 is resting on top of the grating 24 of the floor drain or integrated with the grating 24 of the floor drain 22.

In some cases, the water containment system 10 may be used to encircle a sump pump pit, or a water valve. In FIG. 3, the sump pump or water valve embodiment can be visualized by replacing the water tank with the sump pump pit or valve. A sump pump is a pump used to remove water that has accumulated in a water-collecting sump basin, commonly found in the basements of homes and other buildings, and in other locations where water must be removed, such as construction sites. The water may enter via the perimeter drains of a basement waterproofing system funneling into the basin, or because of rain or natural ground water seepage if the basement is below the water table level. More generally, a sump is any local depression where water may accumulate. For example, many industrial cooling towers have a built-in sump where a pool of water is used to supply water spray nozzles higher in the tower. Sump pumps are used in industrial plants, construction sites, mines, power plants, military installations, transportation facilities, or anywhere that water can accumulate. In some cases, a sump pump may fail, leading to an accumulation of water in the sump pit, which eventually overflows and spills onto the ground surface, where it is collected and redirected via the drain out of the building, in the case where the system 10 is in place. A similar set up may be used to encircle a water valve, to collect and redirect any leaking water from same.

Connections in this document may be achieved using adhesive, welding, fasteners, friction fits, interference fits, clips, latches, compression fits, and other types of connection methods or parts. The parts of the system 10 may be formed of suitable materials, such as resilient or flexible silicon, rubber, plastic, and others.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A water containment system comprising:

a peripheral dam formed of one or more arcuate longitudinal wall sections that are configured to be secured in an assembled position in use around a water tank, water valve, or sump pit, the peripheral dam defining an open tank-valve-or-pit-receiving base; and a drain port defined in the peripheral dam;

in which the peripheral dam comprises a drain wall section that defines the drain port;

in which axial ends of the drain wall section are configured to, in the assembled position, mate with axial ends of adjacent of the one or more arcuate longitudinal wall sections by a tongue and groove connection; and in which the axial ends of the drain wall section comprise:

an outer female flange shaped to permit the axial end of the one or more longitudinal wall section to insert within the outer female flange; and an inner male flange shaped to insert within a hollow interior of the axial end of the one or more longitudinal wall sections.

2. The water containment system of claim 1 in which the peripheral dam forms a ring when in the assembled position.

3. The water containment system of claim 2 in which the peripheral dam is formed of a split ring.

4. The water containment system of claim 1 in which the one or more arcuate longitudinal wall sections comprise flexible or resilient extruded sections.

5. The water containment system of claim 1 in which each of the one or more arcuate longitudinal wall sections comprises a double wall that defines a hollow interior.

6. The water containment system of claim 5 in which each of the one or more arcuate longitudinal wall sections have a triangular cross-sectional wall profile.

7. The water containment system of claim 1 in which a base of each of the one or more arcuate longitudinal wall sections comprises adhesive-receiving channels.

8. The water containment system of claim 1 in which the drain port is formed at least in part by a lateral peripheral flange.

9. The water containment system of claim 8 in which the lateral peripheral flange is a threaded collar or nipple.

10. The water containment system of claim 1 with the peripheral dam secured in the assembled position on a ground surface encircling a water tank.

11. The water containment system of claim 10 in which the drain port is secured to a drain line that runs to a drain.

12. The water containment system of claim 10 in which the peripheral dam is secured by adhesive to one or more of itself and the ground surface.

13. The water containment system of claim 1 with the peripheral dam secured in the assembled position on a ground surface encircling a sump pit.

14. A method comprising configuring the peripheral dam of claim 1 in the assembled position on a ground surface around a water tank that rests on the ground surface.

15. A method of retrofitting a water containment system around a water tank, water valve, or sump pit, the method comprising:

assembling a peripheral dam, formed of one or more arcuate longitudinal wall sections around the water tank, as the water tanks rests on a ground surface, or around the water valve or sump pit;

securing the peripheral dam to the ground surface; and connecting a drain line from a drain port in the peripheral dam to a drain;

in which the peripheral dam comprises a drain wall section that defines the drain port, axial ends of the drain wall section mate with axial ends of adjacent of the one or more arcuate longitudinal wall sections by a tongue and groove connection; and in which the axial ends of the drain wall section comprise:

an outer female flange shaped to permit the axial end of the one or more longitudinal wall section to insert within the outer female flange; and an inner male flange shaped to insert within a hollow interior of the axial end of the one or more longitudinal wall sections.

16. A water containment system comprising:

a peripheral dam formed of one or more arcuate longitudinal wall sections that are configured to be secured in an assembled position in use around a water tank, water valve, or sump pit, the peripheral dam defining an open tank-valve-or-pit-receiving base; and a drain port defined in the peripheral dam;

in which the peripheral dam comprises a drain wall section that defines the drain port;

in which axial ends of the drain wall section are configured to, in the assembled position, mate with axial ends of adjacent of the one or more arcuate longitudinal wall sections, by a tongue and groove connection along the axial ends of the drain wall section and the adjacent of the one or more arcuate longitudinal wall sections.

* * * * *